US008054246B2

(12) United States Patent
Park et al.

(10) Patent No.: US 8,054,246 B2
(45) Date of Patent: Nov. 8, 2011

(54) PLASMA DISPLAY APPARATUS COMPRISING DATA DRIVER HAVING DATA ARRANGING UNIT

(75) Inventors: Seong Hee Park, Gunpo-si (KR); Jeong Pil Choi, Suwon-si (KR)

(73) Assignee: LG Electronics Inc., Seoul (KR)

( * ) Notice: Subject to any disclaimer, the term of this patent is extended or adjusted under 35 U.S.C. 154(b) by 993 days.

(21) Appl. No.: 11/366,614

(22) Filed: Mar. 3, 2006

(65) Prior Publication Data

US 2006/0197719 A1 Sep. 7, 2006

(30) Foreign Application Priority Data

Mar. 3, 2005 (KR) ..... 10-2005-0017934

(51) Int. Cl.
*G09G 3/28* (2006.01)

(52) U.S. Cl. ..... 345/60

(58) Field of Classification Search ..... 345/37, 345/68, 62, 60–61, 63–67, 69–72
See application file for complete search history.

(56) References Cited

U.S. PATENT DOCUMENTS

| | | | | |
|---|---|---|---|---|
| 6,052,112 | A * | 4/2000 | Tanaka et al. | 345/596 |
| 6,154,187 | A * | 11/2000 | Kim | 345/60 |
| 6,271,809 | B1 * | 8/2001 | Kim | 345/60 |
| 6,275,204 | B1 * | 8/2001 | Kim | 345/72 |
| 6,407,506 | B1 * | 6/2002 | Naka et al. | 315/169.1 |
| 6,407,730 | B1 * | 6/2002 | Hori | 345/100 |
| 6,577,071 | B2 * | 6/2003 | Matsumoto | 315/169.4 |
| 6,653,993 | B1 * | 11/2003 | Nagao et al. | 345/60 |
| 6,697,041 | B1 * | 2/2004 | Tamai et al. | 345/100 |
| 2002/0008682 | A1 | 1/2002 | Park | |
| 2002/0015028 | A1 | 2/2002 | Park | 345/204 |
| 2002/0070928 | A1 * | 6/2002 | Awamoto et al. | 345/204 |
| 2003/0058194 | A1 | 3/2003 | Kang | |
| 2004/0001036 | A1 * | 1/2004 | Takayama et al. | 345/62 |
| 2004/0135748 | A1 * | 7/2004 | Yoon et al. | 345/60 |
| 2004/0233132 | A1 * | 11/2004 | Choi et al. | 345/60 |

FOREIGN PATENT DOCUMENTS

| | | |
|---|---|---|
| JP | 11352916 | 12/1999 |
| JP | 2001-255841 | 9/2001 |
| JP | 2002202752 | 7/2002 |
| JP | 2005017725 | 1/2005 |

OTHER PUBLICATIONS

European Search Report dated Jun. 6, 2006.
European Search Report dated May 14, 2009.
Chinese Office Action dated Dec. 5, 2008.

* cited by examiner

*Primary Examiner* — Chanh Nguyen
*Assistant Examiner* — Robert Stone
(74) *Attorney, Agent, or Firm* — KED & Associates, LLP

(57) ABSTRACT

A plasma display apparatus comprises a controller, data transmitting unit, data driver, and plasma display panel. The controller outputs m channels of image data and the data transmitting unit transmits the image data through the m channels. The data driver includes a data arranging unit which receives the m channels of image data and outputs n channels of addressing data. The number n may be greater than m. Also, the data arranging unit may include a memory for storing image data corresponding to one frame, so that a driver of the data arranging unit can receive image data from the controller in any input period of one frame period.

6 Claims, 8 Drawing Sheets

PLASMA DISPLAY APPARATUS COMPRISING DATA DRIVER HAVING DATA ARRANGING UNIT

This Nonprovisional application claims priority under 35 U.S.C. §119(a) on Patent Application No. 2005-0017934 filed in Korea on Mar. 3, 2005 the entire contents of which are hereby incorporated by reference.

BACKGROUND OF THE INVENTION

1. Field of the Invention

This document relates to a plasma display apparatus.

2. Description of the Background Art

FIG. 1 shows a structure of a related art plasma display panel. As shown in FIG. 1, the related art plasma display panel comprises a front panel 100 and a rear panel 110. The front panel 100 comprises a front glass substrate 101 and the rear panel 110 comprises a rear glass substrate 111. The front panel 100 and the rear panel 110 are coupled with each other in parallel at a given distance therebetween.

A scan electrode 102 and a sustain electrode 103 are formed on the front glass substrate 101 to maintain light-emissions of discharge cells through a mutual discharge therebetween. The scan electrode 102 and the sustain electrode 103 each comprise transparent electrodes 102*a* and 103*a* made of a transparent material, for example, indium-tin-oxide (ITO) and bus electrodes 102*b* and 103*b* made of a metal material. A scan signal for scan of the plasma display panel and a sustain signal for discharge maintenance of the plasma display panel are supplied to the scan electrode 102. A sustain signal is mainly supplied to the sustain electrode 103. An upper dielectric layer 104 is formed on upper parts of the scan electrode 102 and the sustain electrode 103 to limit a discharge current and to provide insulation between the scan electrode 102 and the sustain electrode 103. A protective layer 105 is formed of MgO for facilitating discharge conditions on an upper surface of the upper dielectric layer 104.

Address electrodes 113 are formed on the rear glass substrate 111 to intersect the scan electrode 102 and the sustain electrode 103. A lower dielectric layer 115 is formed on an upper part of the address electrode 113 to provide insulation between the address electrodes 113. Barrier ribs 112 are formed on the lower dielectric layer 115 to form discharge cells. A phosphor layer 114 is coated between the barrier ribs 112 to emit visible light for displaying an image.

The front glass substrate 101 and the rear glass substrate 111 are coalesced using a sealing material. After performing an exhaust process, an inert gas such as helium (He), neon (Ne), xenon (Xe) is injected into the inside of the plasma display panel.

A method for representing gray scale through a related art plasma display panel is shown in FIG. 2.

FIG. 2 illustrates a method for representing gray scale of an image of a related art plasma display panel. As shown in FIG. 2, a frame period (16.67 ms) is divided into eight subfields SF1 to SF8. The eight subfields SF1 to SF8 each comprise a reset period, an address period and a sustain period.

The duration of the reset period in one subfield is equal to the durations of the reset periods in the remaining subfields. Likewise the reset period, the duration of the address period in one subfield is equal to the durations of the address periods in the remaining subfields. An address discharge is generated by the voltage difference between an address electrode and a scan electrode during the address period. The duration of the sustain period increases at a ratio of $2^n$ (n=0, 1, 2, 3, 4, 5, 6, 7) in each of the subfields. Since the duration of the sustain period of each of the subfields is different from one another, grey level of various images is represented by controlling the duration of the sustain period of each of the subfields.

A plasma display apparatus for representing gray scale of the images as described above is shown in FIG. 3.

FIG. 3 illustrates a related art plasma display apparatus. As shown in FIG. 3, the related art plasma display apparatus comprises a data driving board 310, a scan driving board 320, a sustain driving board 330 and a control board 340.

The data driving board 310 supplies an address pulse to an address electrode during an address period. The scan driving board 320 supplies to a scan electrode a reset pulse during a reset period, a scan pulse during the address period and a sustain pulse during a sustain period. The sustain driving board 330 supplies a sustain pulse to a sustain electrode during the sustain period. The control board 340 supplies data for controlling each of the pulses supplied from the driving boards 310, 320 and 330 to each of the corresponding driving boards 310, 320 and 330. The control board 340 will be described in detail with reference to FIG. 4.

FIG. 4 illustrates a control board of the related art plasma display apparatus of FIG. 3. As shown in FIG. 4, the related art control board 340 comprises an image signal receiving unit 410, an image signal processing unit 420 and a data arranging unit 430.

The image signal receiving unit 410 receives an image signal input from the outside, transforms the image signal into 8-bit initial image data, and outputs the 8-bit initial image data to the image signal processing unit 420.

The image signal processing unit 420 transforms the initial image data received from the image signal receiving unit 410 into image date suitable for the plasma display panel through an inverse gamma correction process, a gain control process, a half-toning process and a subfield mapping process.

The data arranging unit 430 arranges the image date received from the image signal processing unit 420 by each of subfields, and then transforms the arranged image date into addressing data. The data arranging unit 430 outputs the addressing data to the data driving board 310 through a cable 350 of FIG. 3.

Since a plasma display panel supports high definition, the number of channels of the cables 350 for transmitting the addressing data from the data arranging unit 430 of the control board 340 to the data driving board 310 increases. Accordingly, there is a problem in that the manufacturing cost of the plasma display apparatus increases.

Further, since the larger the size of the plasma display panel is the longer the length of the cable 350 is, a signal loss of the addressing data transmitted through the cable 350 and cross-talk are generated. In particular, when the addressing data is transmitted using a transistor-to-transistor (TTL) method, the signal loss and the generation of a noise increase.

SUMMARY OF THE INVENTION

Accordingly, an object of the present invention is to solve at least the problems and disadvantages of the background art.

Embodiments of the present invention provide a plasma display apparatus for reducing the number of channels of a data transmitting unit.

The embodiments of the present invention also provide a driving apparatus of a plasma display panel capable of reducing a noise of data displayed on a screen by improving the driving apparatus of the plasma display panel.

According to an aspect, there is provided a plasma display apparatus comprising a controller which receives and processes an image signal, comprising m channels for outputting image data, a data transmitting unit for transmitting the image data through the m channels, a data driver comprising a data arrangement unit comprising n channels for outputting addressing data transformed from the image data through the data transmitting unit and outputting an addressing pulse depending on the addressing data, and a plasma display panel comprising an electrode for receiving the addressing pulse, wherein n is a natural number more than m.

According to another aspect, there is provided a plasma display apparatus comprising a controller which receives and processes an image signal, comprising m channels for outputting image data, a data transmitting unit for transmitting the image data through the m channels, a data driver comprising a data arrangement unit comprising n channels for outputting addressing data transformed from the image data through the data transmitting unit and outputting an addressing pulse depending on the addressing data, and a plasma display panel comprising an electrode for receiving the addressing pulse, wherein n is a natural number more than m, and wherein the controller transmits the image data to the data arrangement unit at an input period of one frame period through the data transmitting unit.

According to still another aspect, there is provided a plasma display apparatus comprising a controller which receives and processes an image signal, comprising r channels for outputting image data, a data transmitting unit for transmitting the image data through the r channels, a data driver comprising a data arrangement unit comprising s channels for outputting addressing data transformed from the image data through the data transmitting unit and outputting an addressing pulse depending on the addressing data, and a plasma display panel comprising an electrode for receiving the addressing pulse, wherein s is a natural number more than r, and wherein the image data which the controller transmits to the data arrangement unit through the data transmitting unit, is a differential signal.

According to yet still another aspect, there is provided a plasma display apparatus comprising a controller which receives and processes an image signal, comprising r channels for outputting image data, a data transmitting unit for transmitting the image data through the r channels, a data driver comprising a data arrangement unit comprising s channels for outputting addressing data transformed from the image data through the data transmitting unit and outputting an addressing pulse depending on the addressing data, and a plasma display panel comprising an electrode for receiving the addressing pulse, wherein r is a natural number equal to or less than 20, and s is a natural number more than r, and wherein the image data which the controller transmits to the data arrangement unit through the data transmitting unit, is a differential signal.

The plasma display apparatus according to the embodiments of the present invention reduces the manufacturing cost by reducing the number of channels of the data transmitting unit.

The plasma display apparatus according to the embodiments of the present invention reduces a signal loss and a noise in accordance with data transmission.

BRIEF DESCRIPTION OF THE DRAWINGS

The embodiment of the invention will be described in detail with reference to the following drawings in which like numerals refer to like elements.

DETAILED DESCRIPTION OF PREFERRED EMBODIMENTS

Figure 1:
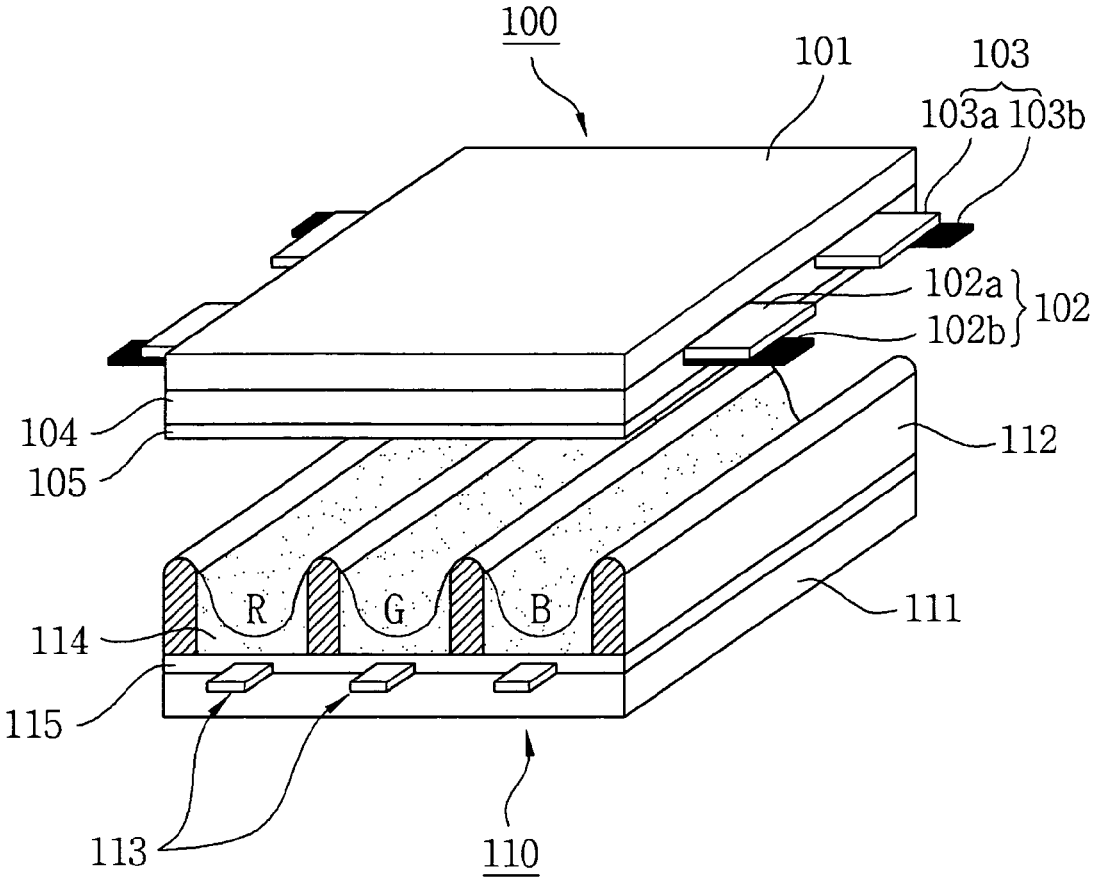
FIG. 1 Related Art
FIG. 1 shows a structure of a related art plasma display panel.
Figure 2:
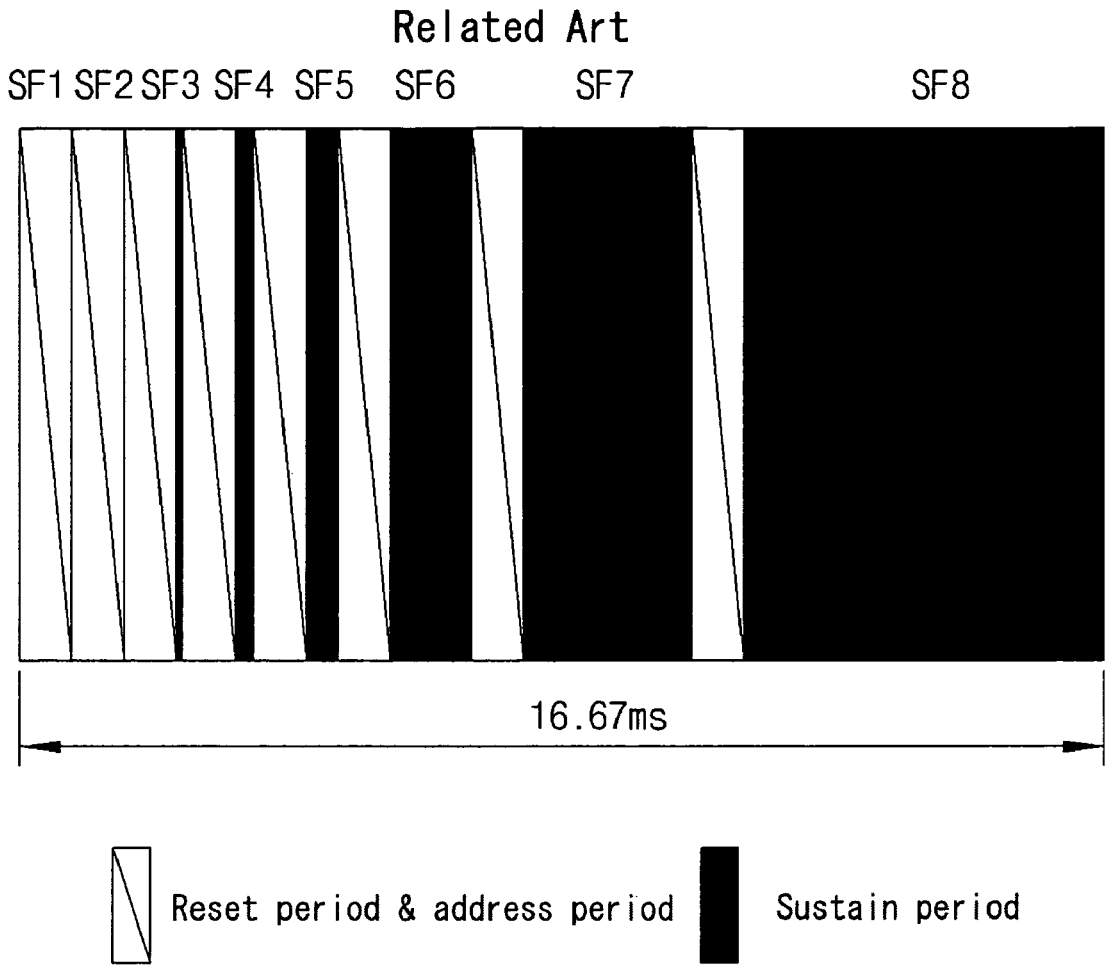
FIG. 2 illustrates a method for representing gray scale of an image of a related art plasma display panel.
Figure 3:
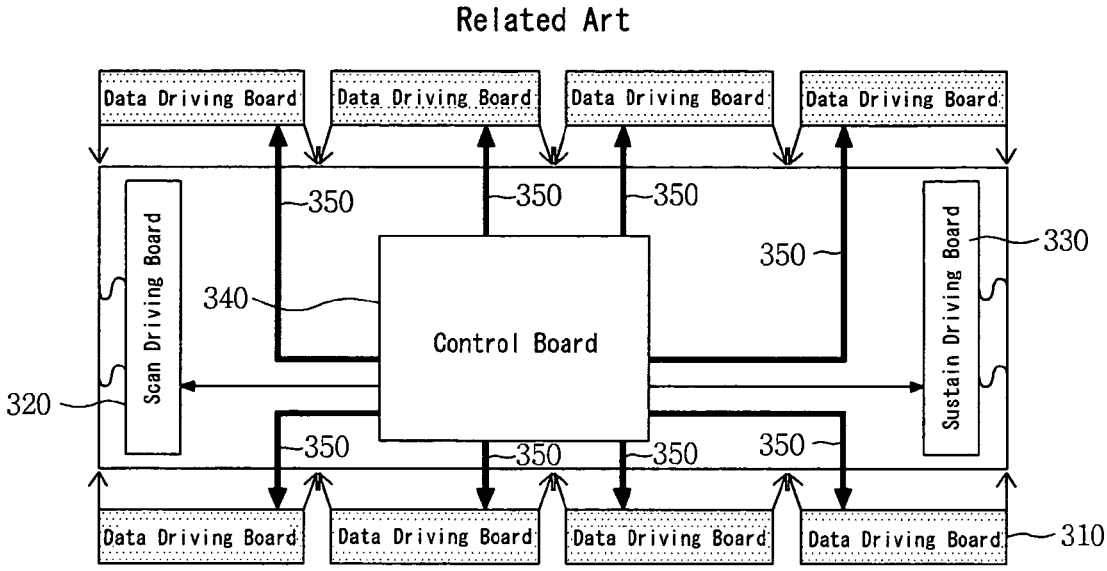
FIG. 3 illustrates a related art plasma display apparatus.
Figure 4:
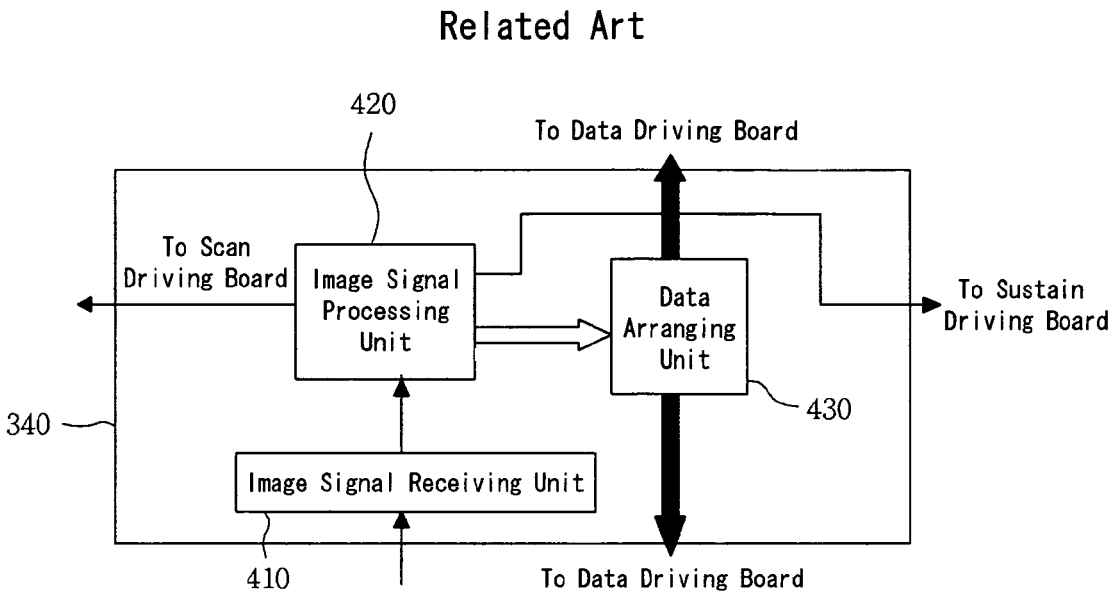
FIG. 4 illustrates a control board of the related art plasma display apparatus of FIG. 3.

Embodiments of the present invention will be described in a more detailed manner with reference to the drawings.

A plasma display apparatus according to embodiments of the present invention comprises a controller which receives and processes an image signal, comprising m channels for outputting image data, a data transmitting unit for transmitting the image data through the m channels, a data driver comprising a data arrangement unit comprising n channels for outputting addressing data transformed from the image data through the data transmitting unit and outputting an addressing pulse depending on the addressing data, and a plasma display panel comprising an electrode for receiving the addressing pulse, wherein n is a natural number more than m.

The data arranging unit may output the addressing data arranged by each of subfields.

The data driver may be formed on one driving board.

The data driver may be formed on two or more driving boards. The data arrangement unit may be formed on one of the two or more driving boards. The plasma display apparatus may further comprise a cable connecting the data arrangement unit formed on the one driving board with the remaining driving boards.

The data driver may comprise p drive ICs for generating the addressing pulse. The data arrangement unit may comprise (p×q) or more pins to apply the addressing data of q-bit to the p drive ICs.

A plasma display apparatus according to the embodiments of the present invention comprises a controller which receives and processes an image signal, comprising m channels for outputting image data, a data transmitting unit for transmitting the image data through the m channels, a data driver comprising a data arrangement unit comprising n channels for outputting addressing data transformed from the image data through the data transmitting unit and outputting an addressing pulse depending on the addressing data, and a plasma display panel comprising an electrode for receiving the addressing pulse, wherein n is a natural number more than m, and wherein the controller transmits the image data to the data arrangement unit at an input period of one frame period through the data transmitting unit.

The frame period may comprise a reset period, an address period and a sustain period. The input period may be at least one of the reset period, the address period or the sustain period.

A plasma display apparatus according to the embodiments of the present invention comprises a controller which receives and processes an image signal, comprising r channels for outputting image data, a data transmitting unit for transmitting the image data through the r channels, a data driver comprising a data arrangement unit comprising s channels for outputting addressing data transformed from the image data through the data transmitting unit and outputting an addressing pulse depending on the addressing data, and a plasma display panel comprising an electrode for receiving the addressing pulse, wherein s is a natal number more than r, and wherein the image data which the controller transmits to the data arrangement unit through the data transmitting unit, is a differential signal.

The controller may transmit the differential signal in a low voltage differential signaling method or a transition minimized differential signing method.

A plasma display apparatus according to the embodiments of the present invention comprises a controller which receives and processes an image signal, comprising r channels for outputting image data, a data transmitting unit for transmitting the image data through the r channels, a data driver comprising a data arrangement unit comprising s channels for outputting addressing data transformed from the image data through the data transmitting unit and outputting an addressing pulse depending on the addressing data, and a plasma display panel comprising an electrode for receiving the addressing pulse, wherein r is a natural number equal to or less than 20, and s is a natural number more than r, and wherein the image data which the controller transmits to the data arrangement unit through the data transmitting unit, is a differential signal.

Hereinafter, exemplary embodiments of the present invention will be described in detail with reference to the attached drawings.

First Embodiment

Figure 5:
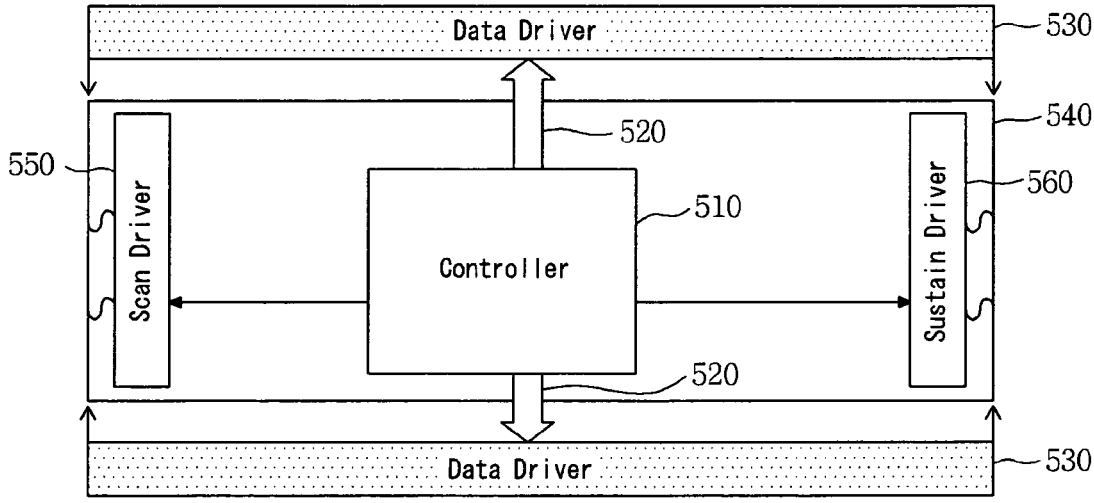
FIG. 5 illustrates a plasma display apparatus according to a first embodiment of the present invention.

FIG. 5 illustrates a plasma display apparatus according to a first embodiment of the present invention. As shown in FIG. 5, the plasma display apparatus according to the first embodiment of the present invention comprises a controller 510, a data transmitting unit 520, a data driver 530, a plasma display panel 540, a scan driver 550 and a sustain driver 560. At least one of the controller 510, the data driver 530, the scan driver 550 or the sustain driver 560 may be formed on one driving board.

The controller 510 controls an operation of each of the data driver 530, the scan driver 550 and the sustain driver 560. The controller 510 receives and processes an image signal, and comprises m channels for outputting image data.

The data transmitting unit 520 transmits the image data received through the m channels. The data transmitting unit 520 comprises a cable. The data transmitting unit 520 further may comprise not only m channels but also a control channel for transmitting a control signal. The data transmitting unit 520 further may comprise a dummy channel.

The data driver 530 comprises a data arranging unit having n channels (n is a natural number more than m) for outputting addressing data transformed from the image data input from the data transmitting unit 520. The data driver 530 outputs an addressing pulse depending on the addressing data.

The plasma display panel 540 comprises an address electrode to which the data driver 530 supplies the addressing pulse during an address period.

The scan driver 550 supplies to a scan electrode of the plasma display panel 540 a reset pulse during a reset period, a scan pulse during the address period and a sustain pulse during a sustain period.

The sustain driving board 330 supplies a sustain pulse to a sustain electrode of the plasma display panel 540 during the sustain period.

Since the data driver 530 of the plasma display apparatus according to the first embodiment of the present invention comprises the data arranging unit, the number of channels of the data transmitting unit 520 decrees. In other words, in a case where the controller comprises the data arranging unit as in the related art, the data arranging unit receives the image data through the m channels and then outputs the addressing data through the n channels. Accordingly, the data transmitting unit must comprise n channels.

However, since the data driver 530 of the plasma display apparatus according to the first embodiment of the present invention comprises the data arranging unit, the data arranging unit of the data driver 530 receives the image data through the m channels of the data transmitting unit 520 and then outputs the addressing data through the n channels.

In other words, while the data transmitting unit of the related art plasma display apparatus comprises the n channels, the data transmitting unit 520 of the plasma display apparatus according to the first embodiment of the present invention comprises the m channels.

The manufacturing cost of the plasma display apparatus according to the first embodiment of the present invention decreases by reducing the number of channels of the data transmitting unit 520.

The controller 510 and the data driver 530 of the plasma display apparatus according to the first embodiment of the present invention will be described in detail with reference to FIGS. 6*a* and 6*b*.

Figure 6A:
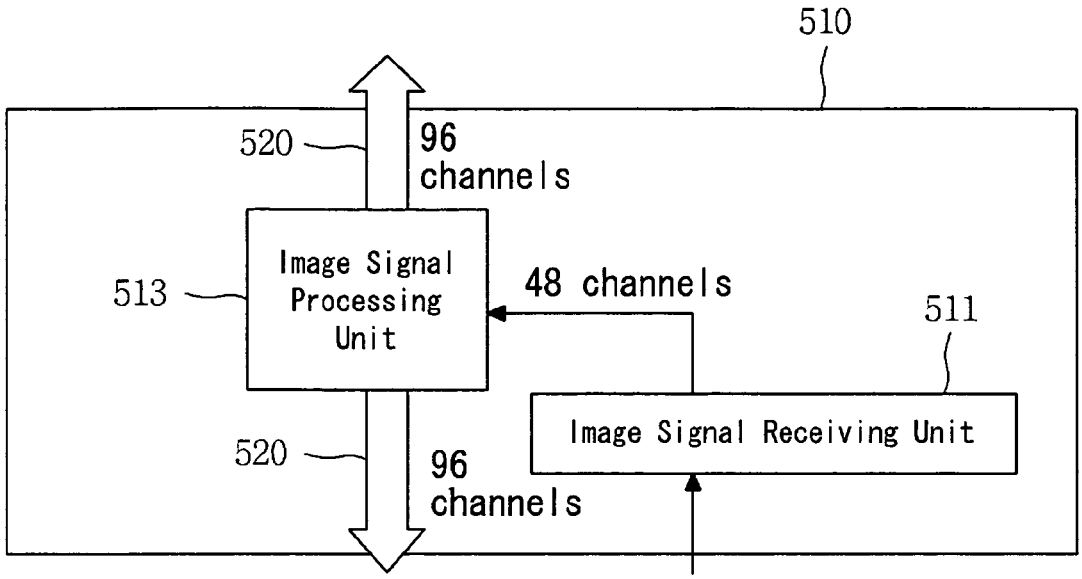
FIG. 6*a* shows a controller of the plasma display apparatus according to the first embodiment of the present invention.

FIG. 6*a* shows a controller of the plasma display apparatus according to the first embodiment of the present invention. FIG. 6*b* shows a data driver of the plasma display apparatus according to the first embodiment of the present invention.

Figure 6B:
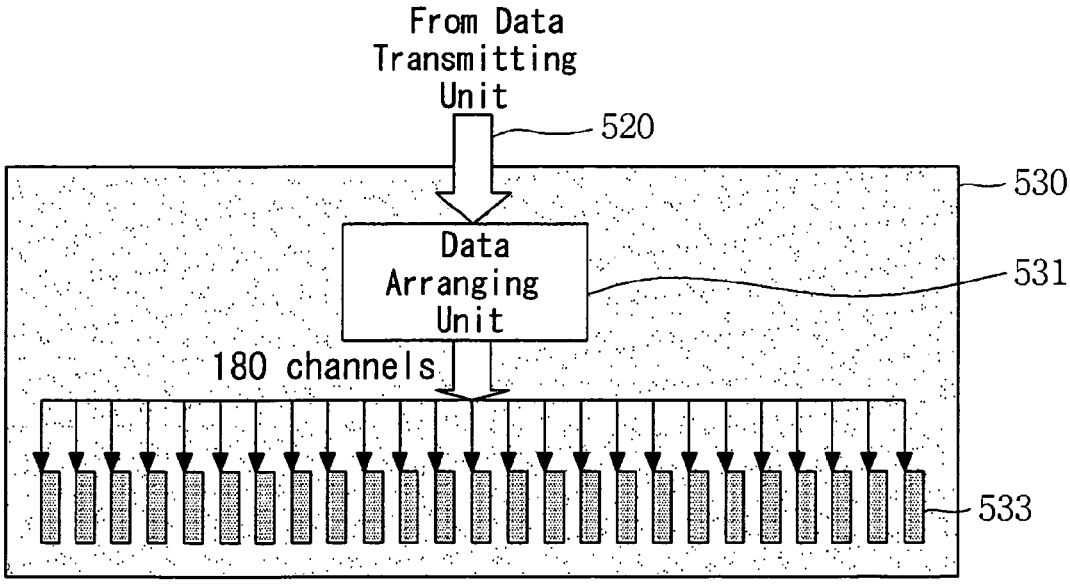
FIG. 6*b* shows a data driver of the plasma display apparatus according to the first embodiment of the present invention.

As shown in FIGS. 6*a* and 6*b*, the controller 510 comprises an image signal receiving unit 511 and an image signal processing unit 513. The data driver 520 comprises a data arranging unit 531 and a drive integrated circuit (IC) 533.

The image signal receiving unit 511 receives an image signal input from the outside, and then outputs the image signal to the image signal processing unit 513. The image signal receiving unit 511 receives the image signal, and then outputs 8-bit data of each of red (R), green (G) and blue (B). Further, when the data driver 530 is formed on each of upper and lower parts of the plasma display panel 540 as shown in FIG. 5, the image signal receiving unit 511 must support a dual channel. Therefore, the image signal receiving unit 511 outputs an initial image data through 48 (=8×3×2) channels.

The image signal processing unit 513 receives the initial image data from the image signal receiving unit 511, and then outputs image data by performing an inverse gamma correction process, a gain control process, a half-toning process and a subfield mapping process. Since the image signal processing unit 513 supports 16-bit data of each of R, G and B and a dual channel, the image signal processing unit 513 comprises 96 (=16×3×2) channels. The 16-bit data comprises information of mapped subfields. Accordingly, the controller 510 comprises 96 (=m) channels.

The data transmitting unit 520 transmits the image data received through 96 channels to the data driver 530. Accordingly, the data transmitting unit 520 supports 96 channels. The data transmitting unit 520 may further comprise the control channel for transmitting the control signal. The data transmitting unit 520 may further comprise the dummy channel.

As shown in FIG. 6*b*, the data arranging unit 531 of the data driver 530 receives the image data from the data transmitting unit 520, rearranges the image date by each of subfields, and generates addressing data The data arranging unit 531 supports the n (=p×q) channels for transmitting q-bit data to p drive ICs 533. Since the data arranging unit 531 transmits the addressing data corresponding to cells located on one line to the drive ICs 533 32 times, the data arranging unit 531 supports 132 (=n) channels for XGA screen resolution and 180 (=n) channels for full HD screen resolution.

The drive IC 533 receives the addressing data from the data arranging unit 531, generates an addressing pulse corresponding to the addressing data, and supplies the addressing pulse to the address electrode of the plasma display panel.

In a case where the controller comprises the data arranging unit as in the related art, the data transmitting unit must support 180 channels. However, since the data driver 530 comprises the data arranging unit 531 in the plasma display apparatus according to the first embodiment of the present invention, the data transmitting unit 520 supports 96 channels. Accordingly, the manufacturing cost of the plasma display apparatus decreases.

The data driver 530 may be formed on one driving board in the plasma display apparatus according to the first embodiment of the present invention. In other words, the data drivers 530 located on each of the upper and lower parts of the plasma display panel 540 may be formed on one driving board.

Figure 7:
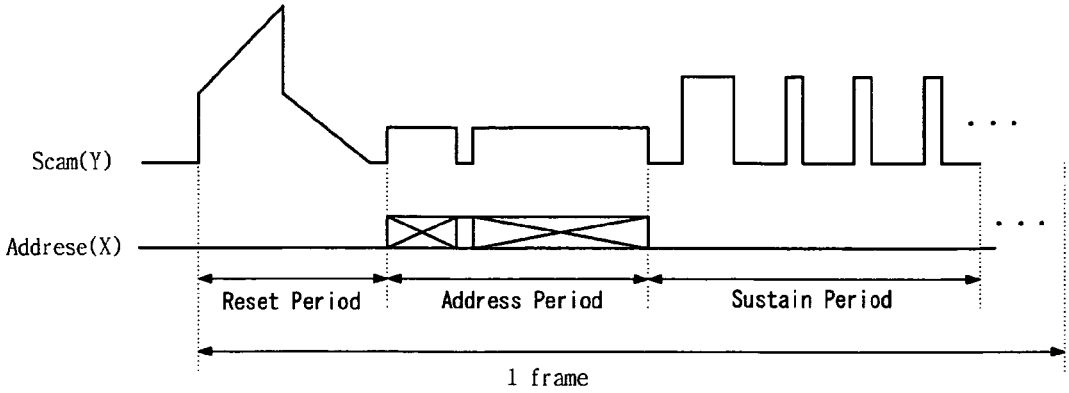
FIG. 7 is a waveform diagram for explaining an operation of the plasma display apparatus according to the first embodiment of the present invention.

FIG. 7 is a waveform diagram for explaining an operation of the plasma display apparatus according to the first embodiment of the present invention. When the data arranging unit 531 of FIG. 6*b* comprises memory capable of storing image data corresponding to one flame, the data arranging unit 531 of the data driver 530 may receive the image data from the controller 510 in any input period of one frame period. In the first embodiment of the present invention, the input period comprises at least one of a reset period, an address period or a sustain period of a subfield included in one flame. However, since the controller comprises the data arranging unit in the related art plasma display apparatus, the data driver receives the image data only in an address period of one subfield.

Second Embodiment

Figure 8:
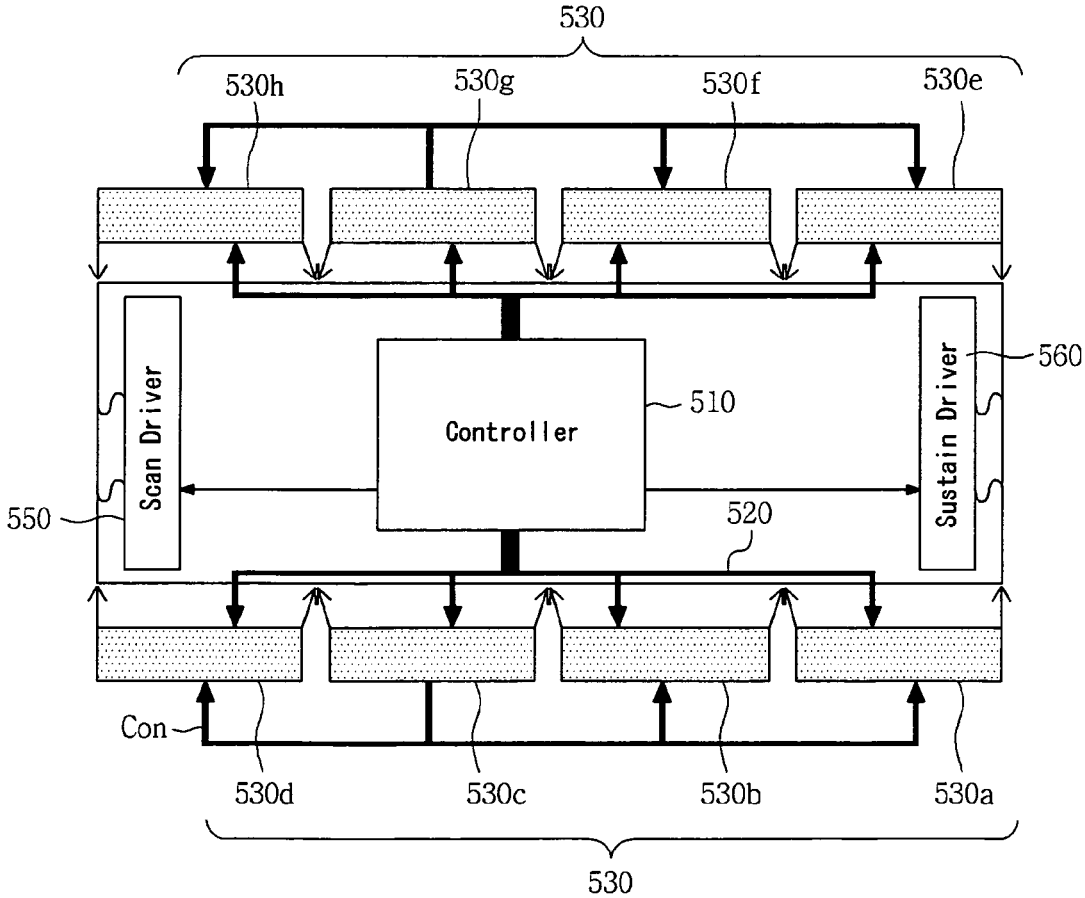
FIG. 8 illustrates a plasma display apparatus according to a second embodiment of the present invention.

FIG. 8 illustrates a plasma display apparatus according to a second embodiment of the present invention. As shown in FIG. 8, the plasma display apparatus according to the second embodiment of the present invention comprises a controller 510, a data transmitting unit 520, a data driver 530, a plasma display panel 540, a scan driver 550 and a sustain driver 560. At least one of the controller 510, the data driver 530, the scan driver 550 or the sustain driver 560 may be formed on one driving board.

Since the controller 510, the data transmitting unit 520, the plasma display panel 540, the scan driver 550 and the sustain driver 560 of the plasma display apparatus according to the second embodiment of the present invention are the same as the first embodiment of the present invention, descriptions thereof are omitted.

Unlike the first embodiment, the data driver 530 of the plasma display apparatus according to the second embodiment of the present invention is formed on a plurality of data driving boards 530*a* to 530*h*. Therefore, a data arranging unit and an interface structure of a drive IC are different from the first embodiment.

Figure 9:
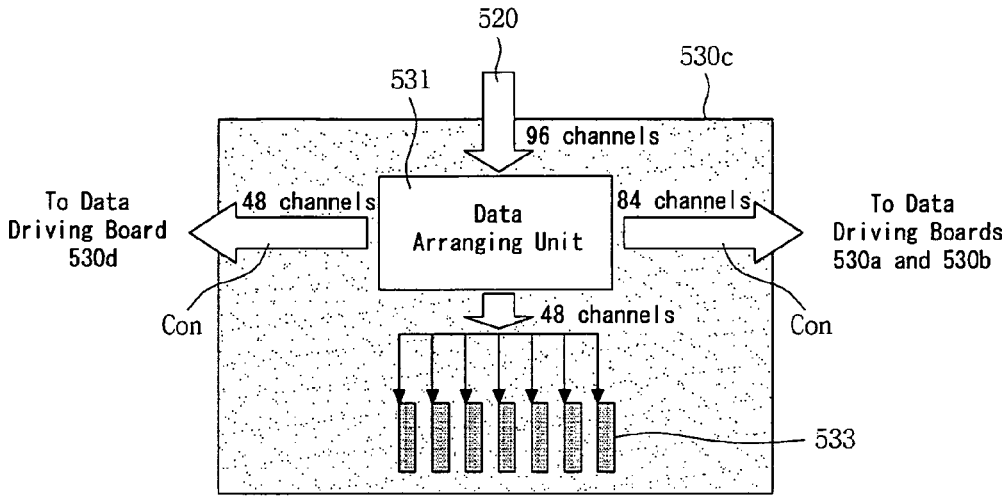
FIG. 9 shows a data driver of the plasma display apparatus according to the second embodiment of the present invention.

FIG. 9 shows a data driver of the plasma display apparatus according to the second embodiment of the present invention. As shown in FIG. 9, one data driving board 530*c* of the plurality of data driving boards 530*a* to 530*h* comprises a data arranging unit 531 and a drive IC 533.

As shown in FIG. 9, the data arranging unit 531 of the data driving boards 530*c* receives image data from the data transmitting unit 520, rearranges the image date by each of subfields, and generates addressing data. The data arranging unit 531 supports n (=p×q) channels for transmitting q-bit data to p drive ICs 533. Since the data arranging unit 531 transmits the addressing data corresponding to cells located on one line to the drive ICs 533 32 times, the data arranging unit 531 supports 132 (=n) channels for XGA screen resolution and 180 (=n) channels for full HD screen resolution.

The data arranging unit 531 according to the second embodiment of the present invention transmits the addressing data to the data drive IC 533 of the data driving board 530*c* through 48 channels. Further, the data arranging unit 531 transmits the addressing data to a data drive IC (not shown) of the data driving board 530*d* through 48 channels and transmits the addressing data to the data driving boards 530*a* and 530*b* through 84 channels. The data driving board 530*c* is connected to the remaining data driving boards 530*a*, 530*b* and 530*d* through a connector Con.

The drive IC 533 receives the addressing data from the data arranging unit 531, generates an addressing pulse corresponding to the addressing data, and supplies the addressing pulse to an address electrode of the plasma display panel.

In a case where the controller comprises the data arranging unit as in the related art, the data transmitting unit must support 180 channels. However, since the data driver 530 comprises the data arranging unit 531 in the plasma display apparatus according to the second embodiment of the present invention, the data transmitting unit 520 supports 96 channels. Accordingly, the manufacturing cost of the plasma display apparatus decreases.

When the data arranging unit 531 of FIG. 9 in the plasma display panel according to the second embodiment of the present invention comprises memory capable of storing image data corresponding to one frame in the same way as the first embodiment, the data arranging unit 531 of the data driver 530 may receive the image data from the controller 510 in any input period of one frame period. In the second embodiment of the present invention, the input period comprises at least one of a reset period, an address period or a sustain period of a subfield included in one frame. However, since the controller comprises the data arranging unit in the related art plasma display apparatus, the data driver receives the image data only in an address period of one subfield.

Third Embodiment

Figure 10:
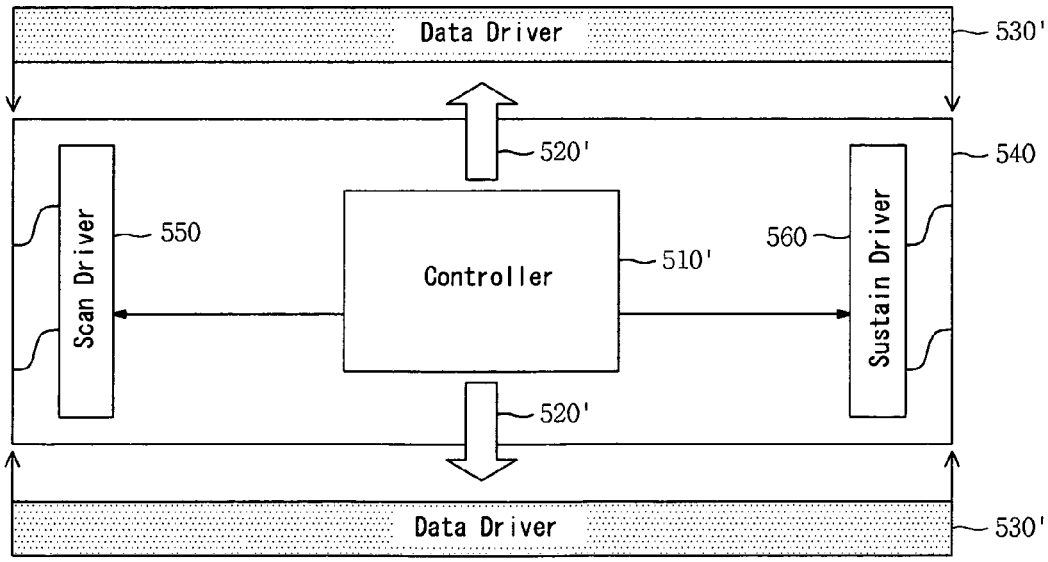
FIG. 10 illustrates a plasma display apparatus according to a third embodiment of the present invention.

FIG. 10 illustrates a plasma display apparatus according to a third embodiment of the present invention. As shown in FIG. 10, the plasma display apparatus according to the third embodiment of the present invention comprises a controller 510', a data transmitting unit 520', a data driver 530', a plasma display panel 540, a scan driver 550 and a sustain driver 560. At least one of the controller 510', the data driver 530', the scan driver 550 or the sustain driver 560 may be formed on one driving board. Since the plasma display panel 540, the scan driver 550 and the sustain driver 560 of the plasma display apparatus according to the third embodiment of the present invention are the same as the second embodiment, descriptions thereof are omitted.

The controller 510' transmits image data in the form of differential signal in the third embodiment of the present invention. Since the controller 510' outputs the image data through 16 (=r) channels, the data transmitting unit 520' supports 16 channels. The controller 510' transmits the differential signal using a low voltage differential signaling (VDS) method or a transition minimized differential signaling (TMDS) method. When the controller 510' transmits the image data in the form of differential signal, the data transmitting unit 520' supports 20 or less channels. The data transmitting unit 520' may further comprise a control channel for transmitting a control signal. The data transmitting unit 520' may further comprise a dummy channel.

Figure 11A:
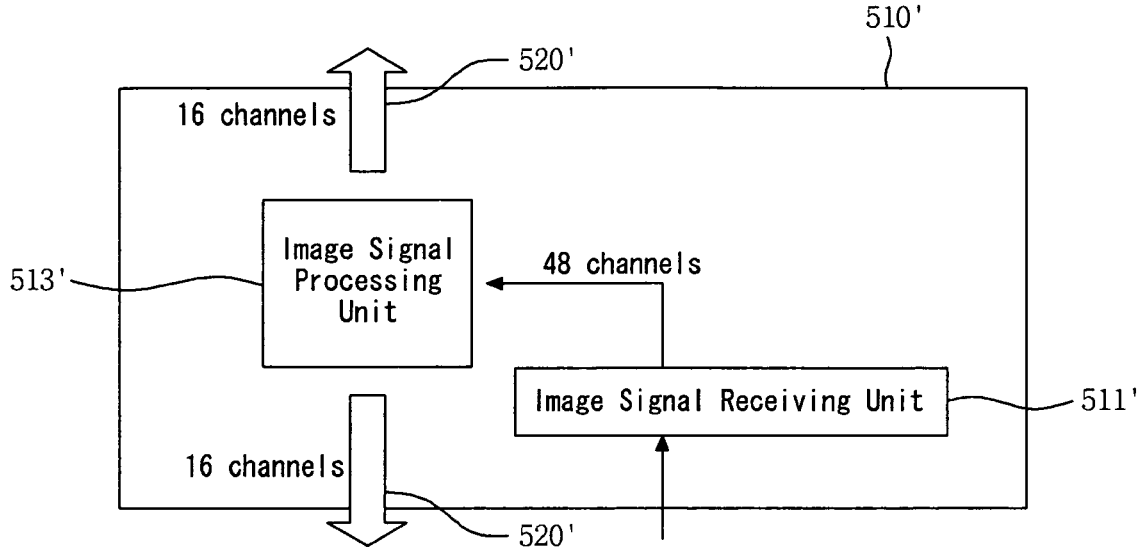
FIG. 11*a* shows a controller of the plasma display apparatus according to the third embodiment of the present invention.
Figure 11B:
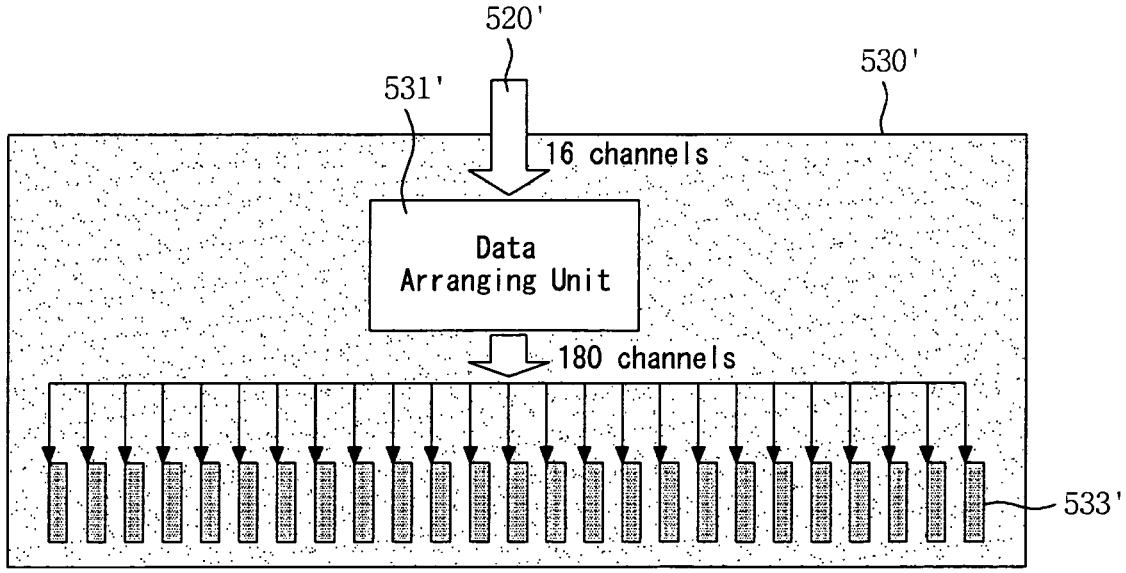
FIG. 11*b* shows a data driver of the plasma display apparatus according to the third embodiment of the present invention.

FIG. 11*a* shows a controller of the plasma display apparatus according to the third embodiment of the present invention. FIG. 11*b* shows a data driver of the plasma display apparatus according to the third embodiment of the present invention.

As shown in FIG. 11*a*, an image signal receiving unit 511' receives an image signal input from the outside, and then outputs the image signal to an image signal processing unit 513'. The image signal receiving unit 511' receives the image signal, and then outputs 8-bit data of each of R, G and B. Further, when the data driver 530' is formed on each of upper and lower parts of the plasma display panel 540 as shown in FIG. 10, the image signal receiving unit 511' must support a dual channel. Therefore, the image signal receiving unit 511' outputs an initial image data through 48 (=8×3×2) channels.

The image signal processing unit 513' receives the initial image data from the image signal receiving unit 511', and then outputs an image data by performing an inverse gamma correction process, a gain control process, a half-toning process and a subfield mapping process. The image signal processing unit 513' transmits the image data in the form of differential signal. Since the image data is 74.25 MHz in the first and second embodiments, the image data of 74.25 MHz is transmitted through 96 channels. When the image data in the third embodiment is transformed into image data of 148.5 MHz and then the image data of 148.5 MHz is transmitted using the LVSD method or the TMDS method, &e image data of 148.5 MHz may be transmitted through 16 (=r) channels. Accordingly, the number of channels supported by the data transmitting unit in the third embodiment decreases in comparison to the first and second embodiments. Further, the differential signal reduces a noise. The differential signal is also advantageous in the long distance transmission of the image data in comparison to a transistor-to-transistor (TTL) signal.

As shown in FIG. 11*b*, the data arranging unit 531' of the data driver 530' rearranges the image date input through the 16 channels by each of subfields, and then generates addressing data The data arranging unit 531' supports s (=p×q) channels for transmitting q-bit data to p drive ICs 533. Since the data arranging unit 531' transmits the addressing data corresponding to cells located on one line to the drive ICs 533' 32 times, the data arranging unit 531' supports 132 (=s) channels for XGA screen resolution and 180 (=s) channels for full HD screen resolution.

When the data arranging unit 531' of FIG. 11*b* according to the third embodiment of the present invention comprises memory capable of storing image data corresponding to one frame in the same way as the first and second embodiments, the data arranging unit 531' of the data driver 530' may receive the image data from the controller 510 in any input period of one frame period. In the third embodiment of the present invention, the input period comprises at least one of a reset period, an address period or a sustain period of a subfield included in one frame. However, since the controller comprises the data arranging unit in the related art plasma display apparatus, the data driver receives the image data only in an address period of one subfield.

The embodiment of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a controller which receives and processes an image signal, the controller having m channels for outputting image data, where m is a natural number greater than one;

a data transmitter to transmit the image data through the m channels;

a data driver comprising a data arranger having n channels to output addressing data transformed from the image data received through the data transmitter and a drive integrated circuit (IC) to generate an addressing pulse depending on the addressing data and outputting the addressing pulse, where n is a natural number greater than one; and a plasma display panel comprising an electrode for receiving the addressing pulse, wherein the number n is greater than the number m, and wherein the controller is configured to transmit the image data to the data arranger in any one of a plurality of input periods of one frame period through the data transmitter, wherein said plurality of input periods includes one or more of a reset period, an address period, or a sustain period, wherein the data arranger receives the image data through the data transmitter and rearranges the image data according to each of a plurality of subfields and generates the addressing data for output through the n channels based on the rearranged image data, wherein the data arranger comprises a memory to store image data corresponding to one frame, and wherein the data arranger and the drive integrated circuit (IC) are on one driving board, the controller is provided independently from the data driver, and the data transmitter further comprises a dummy channel.

2. The plasma display apparatus of claim 1, wherein the data arranger outputs the addressing data arranged by one or more subfields.

3. The plasma display apparatus of claim 1, wherein the data driver is formed on two or more driving boards, the data arranger is formed on one of the two or more driving boards, and the plasma display apparatus further comprises a cable connecting the data arrangement unit formed on the one driving board with the remaining driving boards.

4. The plasma display apparatus of claim 1, wherein the data driver comprises p drive ICs for generating the addressing pulse, and the data arranger comprises (p×q) or more channels to apply the addressing data of q-bit to the p drive ICs, wherein p and q are natural numbers.

5. The plasma display apparatus of claim 1, wherein said m channels are proportional to a product of a number of bits used to represent each of a plurality of colors of the image data, a number corresponding to the plurality of colors, and a number corresponding to a channel multiple.

6. The plasma display apparatus of claim 5, wherein the channel multiple corresponds to a dual channel.

* * * * *